US005836032A

United States Patent [19]

Hondo

[11] Patent Number: 5,836,032

[45] Date of Patent: Nov. 17, 1998

[54] APPARATUS FOR REMOVING HAIR FROM A DRAIN

[76] Inventor: Leslie H. Hondo, 230 Alu Rd., Wailuku, Maui, Hi. 96793

[21] Appl. No.: 941,875

[22] Filed: Sep. 30, 1997

[51] Int. Cl.[6] ..... B08B 9/02

[52] U.S. Cl. ..... 15/104.32; 15/104.001; 15/104.05; 15/104.31; 15/104.33

[58] Field of Search ..... 15/104.001, 104.03, 15/104.05, 104.16, 104.2, 104.31, 104.32, 104.33; 294/26

[56] References Cited

U.S. PATENT DOCUMENTS

| | | | |
|---|---|---|---|
| 584,508 | 6/1897 | Hughes | 15/104.31 |
| 834,135 | 10/1906 | Hymes | 15/104.33 |
| 963,965 | 7/1910 | Weber | 15/104.32 |
| 1,051,992 | 2/1913 | Fisher et al. | 15/104.001 X |
| 1,758,504 | 5/1930 | English | 15/104.32 X |
| 1,780,436 | 11/1930 | Miller | 15/104.33 |
| 2,096,162 | 10/1937 | Daley | 15/104.05 X |
| 2,114,236 | 4/1938 | Pellette | 15/104.31 |
| 2,184,216 | 12/1939 | Gross | 294/26 |

FOREIGN PATENT DOCUMENTS

| | | | |
|---|---|---|---|
| 457821 | 9/1916 | France | 15/104.31 |
| 2262792 | 6/1992 | United Kingdom | 15/104.001 |

*Primary Examiner*—Mark Spisich

[57] ABSTRACT

An apparatus for removing hair from a drain for facilitating the maintenance of drains by permitting convenient periodic debris removal and cleaning of a drain. The apparatus includes an elongate shaft with a plurality of hook members for picking up hair and debris located at the proximal end of the shaft and a handle located at the distal end.

9 Claims, 3 Drawing Sheets

APPARATUS FOR REMOVING HAIR FROM A DRAIN

BACKGROUND OF THE INVENTION

1. Field of the Invention

The present invention relates to drain cleaning devices and more particularly pertains to a new apparatus for removing hair from a drain for facilitating the maintenance of drains by permitting convenient periodic debris removal and cleaning of a drain.

2. Description of the Prior Art

The use of drain cleaning devices is known in the prior art. More specifically, drain cleaning devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art drain cleaning devices include U.S. Pat. No. 5,018,234; U.S. Pat. No. 5,226,207; U.S. Pat. No. 4,967,441; U.S. Pat. No. 4,825,477; U.S. Pat. No. 4,033,650; and U.S. Pat. No. Des. 307,831.

While these devices fulfill their respective, particular objectives and requirements, the aforementioned patents do not disclose a new apparatus for removing hair from a drain. The inventive device includes an elongate shaft with a pick up means for picking up hair and debris located at the proximal end of the shaft and a handle located at the distal end.

In these respects, the apparatus for removing hair from a drain according to the present invention substantially departs from the conventional concepts and designs of the prior art, and in so doing provides an apparatus primarily developed for the purpose of for facilitating the maintenance of drains by permitting convenient debris removal and cleaning of a drain.

SUMMARY OF THE INVENTION

In view of the foregoing disadvantages inherent in the known types of drain cleaning devices now present in the prior art, the present invention provides a new apparatus for removing hair from a drain wherein the same can be utilized for for facilitating the maintenance of drains by permitting convenient debris removal and cleaning of a drain.

The general purpose of the present invention, which will be described subsequently in greater detail, is to provide a new apparatus for removing hair from a drain and method of use thereof which has many of the advantages of the drain cleaning devices mentioned heretofore and many novel features that result in a new apparatus for removing hair from a drain which is not anticipated, rendered obvious, suggested, or even implied by any of the prior art drain cleaning devices, either alone or in any combination thereof.

To attain this, the present invention generally comprises an elongate shaft with a pick up means for picking up hair and debris located at the proximal end of the shaft and a handle located at the distal end.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new apparatus for removing hair from a drain and method of use thereof which has many of the advantages of the drain cleaning devices mentioned heretofore and many novel features that result in a new apparatus for removing hair from a drain which is not anticipated, rendered obvious, suggested, or even implied by any of the prior art drain cleaning devices, either alone or in any combination thereof.

It is another object of the present invention to provide a new apparatus for removing hair from a drain which may be easily and efficiently manufactured and marketed.

It is a further object of the present invention to provide a new apparatus for removing hair from a drain which is of a durable and reliable construction.

An even further object of the present invention is to provide a new apparatus for removing hair from a drain which is susceptible of a low cost of manufacture with regard to both materials and labor, and which accordingly is then susceptible of low prices of sale to the consuming public, thereby making such apparatus for removing hair from a drain economically available to the buying public.

Still yet another object of the present invention is to provide a new apparatus for removing hair from a drain which provides in the apparatuses and methods of the prior art some of the advantages thereof, while simultaneously overcoming some of the disadvantages normally associated therewith.

Still another object of the present invention is to provide a new apparatus for removing hair from a drain for facilitating the maintenance of drains by permitting convenient debris removal and cleaning of a drain.

Yet another object of the present invention is to provide a new apparatus for removing hair from a drain which includes an elongate shaft with a pick up means for picking up hair and debris located at the proximal end of the shaft and a handle located at the distal end.

Still yet another object of the present invention is to provide a new apparatus for removing hair from a drain that provides an economical apparatus for removing hair and other debris from otherwise difficult-to-reach areas of a drain in a manner which permits disposal of the hair and debris in the trash and reuse of the apparatus, or disposal of the entire unit in the trash.

Even still another object of the present invention is to provide a new apparatus for removing hair from a drain that may be hung in a location easily accessible to the drain.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
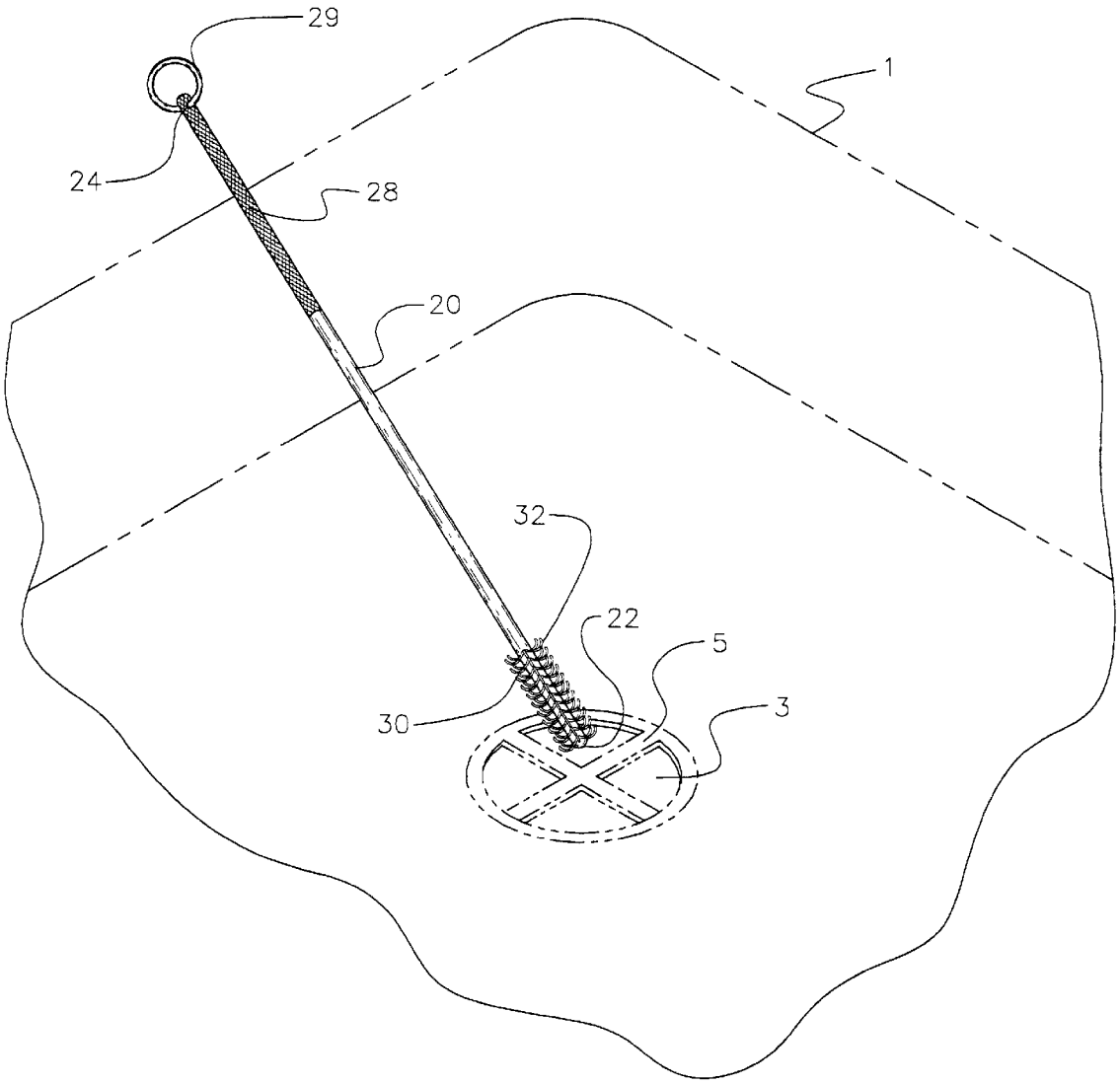
FIG. 1 is a schematic perspective view of a new apparatus for removing hair from a drain according to the present invention.
Figure 2:
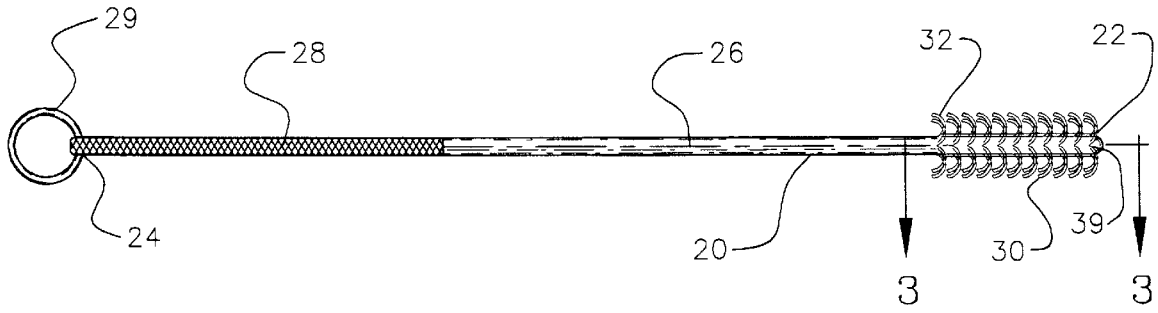
FIG. 2 is a schematic plan view of the present invention.
Figure 3:
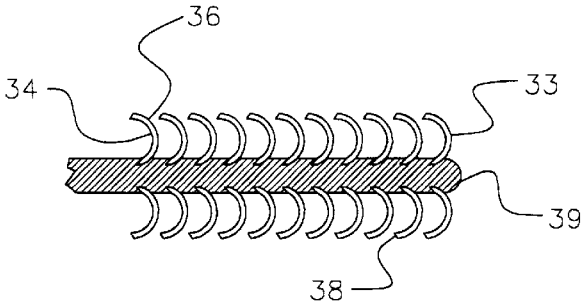
FIG. 3 is a schematic sectional view of the proximal end of the present invention taken along line 3—3 of FIG. 2 detailing the pick up means.
Figure 4:
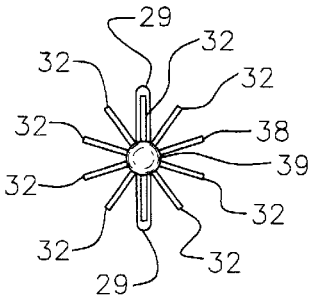
FIG. 4 is a schematic end view of the present invention.
Figure 5:
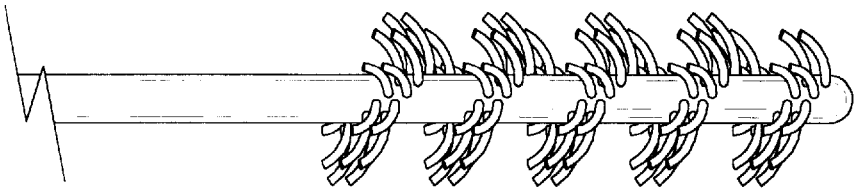
FIG. 5 is a schematic view of the proximal end of the present invention detailing a helical arrangement of the pick up means.

With reference now to the drawings, and in particular to FIGS. 1 through 4 thereof, a new apparatus for removing hair from a drain embodying the principles and concepts of the present invention will be described.

As best illustrated in FIGS. 1 through 4, the apparatus for removing hair from a drain comprises an elongate shaft 20 with a pick up means 30 for picking up hair and debris being provided at the proximal end 22 of the shaft 20.

The shaft 20 is preferably elongate with its proximal end 22 adapted to be inserted into a drain 3. The elongate and relatively thin nature of the shaft 20 permits insertion of the proximal end 22 through a drain guard 5 covering the entrance to the drain 3 and into the drain pipe (not shown) in communication with the drain entrance. Ideally, the shaft 20 is flexible along its longitudinal axis 26. The longitudinally flexible nature of the shaft 20 permits the shaft to bend and curve and follow the curvature of the interior of the drain pipe for reaching relatively remote obstructions in the drain pipe (e.g., those obstructions not in the immediate entrance of the drain). This flexibility characteristic also allows the shaft 20 to be thrust vigorously through an obstruction in the drain 3.

The shaft 20 includes a grasping portion (or handle) 28 for aiding the grasping of the shaft 20 by a user. The grasping portion 28 is preferably positioned towards the shaft distal end 24 and opposite the proximal end 22. Preferably, a ring 29 is mounted on and extends from the distal end 24. The ring 29 enhances the storability of the apparatus by permitting it to be hung from, for example, a hook on a wall surface. Significantly, the ring 29 also aids in maneuvering the apparatus, such as, for example, when rotational movement of the shaft 20 is used to slide the proximal end 22 through the drain 3 and for engaging an obstruction.

The pick up means 30 is located near the proximal end 22 of the shaft 20 for enhanced ability to engage drain debris. The pick up means 30 is preferably comprised of a plurality of hooking members 32 extending in a generally radial direction from around the shaft 20. The hooking members 32 are preferably somewhat flexible but resilient in nature to aid in hooking onto and pulling out hair and debris located in a drain.

Significantly, each hooking member 32 preferably has a hooked or arcuate curved region 33 especially suited for retrieving strands of hair from a drain 3. Each arcuate hooking member 32 has a concave region 34 directed towards or substantially facing the shaft distal end 24 and also a convex region 36 directed toward or facing the shaft proximal end 22. This preferred form permits the hooking members 32 to hook into and hold onto strands or clumps of strands of hair (and other debris) located in the drain 3 as the apparatus is withdrawn or pulled from the drain.

Preferably, the hooking members 32 are arranged in a plurality of spaced rows 38 such that debris moving into a space 39 between rows is more readily contacted and hooked by a hooking member in one of the rows 38 adjacent to the space 39. Each row 38 extends from a location adjacent to the shaft proximal end 22 towards the shaft distal end 24. Ideally, the hooking members 32 are arranged in rows 38 (as seen in FIG. 1) which extend substantially parallel to the shaft longitudinal axis 26 and to the plane in which the curved hooking members 32 lie for enhanced hooking contact between the members 32 and the debris. Optionally, the rows 38 of hooking members 32 may be arranged in a helical configuration of spaced rows around the shaft 20.

Ideally, the hooking members 32 are fabricated from a plastic that has a resilient flexibility characteristic that is similar, for example, to the hook portion of a hook and loop fastener (sold under the tradename VELCRO). Material of this character is capable of being bent repeatedly without damage, however any suitably strong and resiliently flexible material may be used. Optionally, the hooking members 32 may be fabricated from flexible metallic materials. Fabrication from a plastic is also preferred because plastic is resistant to corrosion. Plastic is also preferred for the shaft 20 for its moldable, flexible, and corrosion resistant (for use in a wet environment) characteristics.

In using the apparatus for collecting hair from the interior of a drain 3, the elongate shaft 20 is grasped by a hand of the user placed on the grasping portion 28. The proximal end 22 of the shaft 20 is inserted through and beyond the drain guard 5 and into a drain 3 of a tub or sink 1. The hooking members 32 of the pick up means 30 pick up hair and debris in the drain 3 when the user agitates the shaft 20 in an up and down motion with respect to the longitudinal axis 26. The shaft is moved in an up and down motion, in conjunction with thrusts when obstructions are contacted. The apparatus may be withdrawn through the drain guard 5 and the hooking members 32 are inspected for debris thereon. The movement of the shaft 20 is repeated until the hooking members 32 no longer contact and retrieve debris from the drain 3 when the shaft 20 is withdrawn therefrom. The debris collected by the apparatus 10 is removed from the hooking members 32 and put into the trash. The cleaned apparatus may be hung from the ring 29. Optionally, the apparatus may itself be disposed of in the trash with the debris.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An apparatus for removing hair and other debris from a drain, comprising:

an elongate shaft having a longitudinal axis, a proximal end, and a distal end, said shaft proximal end being for insertion into a drain; and pick up means for picking up hair and dirt, said pick up means being provided at proximal end of said shaft;

wherein said pick up means includes a plurality of rows of hooking members, the rows being helically configured around the longitudinal axis.

2. An apparatus for removing hair and other debris from a drain, comprising:

an elongate shaft having a longitudinal axis, a proximal end, and a distal end, said shaft proximal end being for insertion into a drain; and pick up means for picking up hair and dirt, said pick up means being provided at proximal end of said shaft;

wherein said pick means comprises a plurality of hooking members being extended radially around said shaft, said hooking members being for picking up hair and debris disposed within a drain;

wherein said hooking members are located towards said shaft proximal end;

wherein said hooking members are arranged in a plurality of rows, said rows being extended from said shaft proximal end towards said shaft distal end; and wherein said rows are helically configured around said longitudinal axis.

3. The apparatus of claim 2, wherein said hooking members are resilient to aid picking up hair and debris from a debris.

4. The apparatus of claim 2, wherein each said hooking member has an arcuate curved region, said curved region having a concave portion and a convex portion.

5. The apparatus of claim 4, wherein said concave portion substantially face towards said shaft distal end, said convex portion substantially facing towards said shaft proximal end.

6. The apparatus of claim 2, wherein said shaft is flexible along said longitudinal axis.

7. The apparatus of claim 2, further comprising a ring being extended from said shaft distal end.

8. The apparatus of claim 2, further comprising a grasping portion being positioned towards said shaft distal end, said grasping portion being for aiding the grasping of said shaft by a user.

9. An apparatus for removing hair and other debris from a drain, comprising:

an elongate shaft having a longitudinal axis, a proximal end, and a distal end, said shaft being flexible along said longitudinal axis, said shaft proximal end being for insertion into a drain, said shaft having a substantially constant cross-section from the proximal to the distal end thereof;

a ring being extended from said shaft distal end;

a grasping portion being positioned towards said shaft distal end, said grasping portion being for aiding the grasping of said shaft by a user; and a plurality of hooking members being extended radially around said shaft, each said hooking member having an arcuate curved region, said curved region having a concave portion and a convex portion, said concave portion substantially facing towards said shaft distal end, said convex portion substantially facing towards said shaft proximal end, said hooking members being located towards said shaft proximal end, said hooking members being arranged in a plurality of rows, said rows being extended from said shaft proximal end towards said shaft distal end, said rows being substantially parallel to said longitudinal axis, said hooking members being for picking up hair and debris disposed within a drain, said hooking members being resilient to aid picking up hair and debris from a debris.

* * * * *